US008424973B2

(12) United States Patent
Bodley et al.

(10) Patent No.: US 8,424,973 B2
(45) Date of Patent: Apr. 23, 2013

(54) COLLAPSIBLE CUSHION

(75) Inventors: Nicholas Grant Bodley, Scarborough (AU); Terrence Peter Clarke, North Beach (AU); Justin Andrew Widdifield, Ontario (CA)

(73) Assignee: MTI Products PTY Ltd., West Perth, WA (AU)

( * ) Notice: Subject to any disclaimer, the term of this patent is extended or adjusted under 35 U.S.C. 154(b) by 360 days.

(21) Appl. No.: 12/616,885

(22) Filed: Nov. 12, 2009

(65) Prior Publication Data

US 2010/0295359 A1 Nov. 25, 2010

(30) Foreign Application Priority Data

May 20, 2009 (AU) ..... 2009902287

(51) Int. Cl.
*E21D 15/00* (2006.01)

(52) U.S. Cl.
USPC ..... 299/10; 405/289

(58) Field of Classification Search ..... 405/289; 299/10

See application file for complete search history.

(56) References Cited

U.S. PATENT DOCUMENTS

| | | | | |
|---|---|---|---|---|
| 2,990,166 | A * | 6/1961 | Walsh | 299/11 |
| 3,710,718 | A * | 1/1973 | Grant | 102/313 |
| 4,906,133 | A * | 3/1990 | Martin | 405/289 |
| 6,857,706 | B2 | 2/2005 | Hames et al. | |

* cited by examiner

*Primary Examiner* — John Kreck
(74) *Attorney, Agent, or Firm* — Edell, Shapiro & Finnan, LLC

(57) ABSTRACT

A method of mining a valuable metal or material in an ore body is described. The method comprises the steps of: a) placing a cushion in a stope whereby the cushion creates a void into which fragmented rock can expand during subsequent blasting operations for a second or subsequent panel; and, b) maintaining the void until blasting operations occur whereupon the void is caused to collapse to accommodate fragmented ore generated during blasting operations.

32 Claims, 5 Drawing Sheets

COLLAPSIBLE CUSHION

FIELD

The present invention relates generally to the mining valuable mineral and/or metal deposits and particularly though not exclusively to an inflatable cushion used to create and maintain a void during backfill operations.

BACKGROUND

Valuable metals and minerals are frequently contained in subterranean deposits referred to in the art as "ore bodies". Such ore bodies are typically located at varying depths in hard or high strength barren rock. Before mining can commence, a number of underground excavations must be developed at a plurality of levels to facilitate access to the ore body at each level.

Several methods have been developed to mine such ore bodies to recover the valuable metals or minerals, some examples of which are described, in U.S. Pat. No. 6,857,706. During mining operations, each cut or "panel" of ore is removed sequentially by drilling a plurality of vertically extending boreholes, loading explosive charges into each borehole and blasting. The blasted ore or rock material is gathered or "mucked" to a loading or draw point. Thereafter, a cavity referred to in the art as a "stope" is created by removal of the broken ore is backfilled with waste material such as mine tailings, concrete, cement rock fill, or paste fill.

Once rock is fragmented, the release of pressure causes it to expand therefore occupying a larger volume than before. Using the processes of the prior art, a space or void for receiving the fragmented rock is created by mining an elongated substantially vertical or inclined shaft extending between a lower level and an upper level of the mine, referred to in the art as a "rise". Developing a rise for every production panel of the stope being mined can be both time consuming and expensive.

There remains a need for more efficient or economical methods for underground mining.

SUMMARY

According to one aspect of the present invention there is provided a method of mining a valuable metal or material in an ore body comprising the steps of:

a) placing a collapsible cushion in a stope whereby the cushion creates a void into which fragmented rock can expand during subsequent blasting operations for a second or subsequent panel; and, b) maintaining the void until blasting operations occur whereupon the void is caused to collapse to accommodate fragmented ore generated during blasting operations.

In one form, the cushion is inflatable which is advantageous in that the cushion can be transported to the stope in a deflated condition and inflated underground. In one form, the cushion is inflated in-situ during step a). In one form, step a) comprises placing the cushion adjacent to an ore body facing wall.

In one form, the method further comprises the step of backfilling the stope to secure the position of the cushion within the stope during step b). When the cushion is inflatable, the overall shape of the inflated cushion can be modified by only partially inflating the cushion. Thus, in one form, the inflated condition of step b) is a fully inflated condition. In one form, the cushion is partially or completely filled with a compressible fluid and the fluid within the cushion is compressed to occupy a smaller volume as a result of pressure being applied to the cushion by the fragmented ore during blasting operations. Alternatively, the cushion is filled with an incompressible substance and the cushion is punctured or vented to release the incompressible substance during or prior to blasting operations.

In one form the cushion is capable of withstanding forces of 0.5 to 50 psi (3.5 to 350 kPa) of internal pressure during step b).

Preferably, the cushion comprises an elongate fluid-tight housing having at least one cavity therein which is isolated from the surrounding atmosphere and is capable of retaining a substance under pressure. To resist damage occurring prior to blasting operations, the housing may be constructed of a tear-resistant material. In one form, the housing is constructed from a woven polypropylene or a woven polyethylene.

The ore body is accessible via upper and lower spaced-apart access located at different levels. Whilst the cushion may be dimensioned such that the length of the cushion, in use, extends substantially along the full distance between the floor of the upper drive and the ceiling of the lower drive, in one form of the present invention, the cushion is dimensioned such that the length of the cushion is not less than 80%, not less than 85%, not less than 90% or not less than 95% of the distance between the floor of the upper drive and the ceiling of the lower drive. The cushion may be dimensioned such that the width of the cushion, in use, extends substantially across the full width of the second or subsequent panel as measured across a wall of the ore body facing the stope. Alternatively or additionally, the width of the cushion is 5% to 75% of the width of the second or subsequent panel as measured across a wall of the ore body facing the stope. In this form, the cushion may be one of a plurality of cushions arranged in a side-by-side configuration.

Advantageously, an umbilical line is used to regulate or monitor the pressure within the cushion during step b). In one form, a pressure sensing means is used for providing feedback signals to a controller regarding the internal pressure of the cushion during step b), and wherein the feedback signal is compared with a fluid pressure set point whereby the controller operates to regulate the flow of pressurized fluid through an umbilical line to the cushion to ensure that the pressure within the cushion is maintained above the set point until the blasting operation commences.

Preferably, the cushion further comprises an elongate fluid-tight inner container. In one form, the inner container is formed from a fluid impervious material capable of retaining a fluid under pressure. When the cushion comprises an inner container, the housing may be a bag, sleeve or other receptacle within which a fluid-tight inner container is placed.

In one form, the inner container and the housing are dimensioned so that, upon inflation, the inner container fits snugly inside the housing.

Preferably, the inner container is constructed of a material having low fluid permeability. In one form, the inner container may be constructed of one or more materials selected from the group comprising: plastic materials, rubber or other elastomerics, extrusion grade nylon, polyethylene, polyurethane, polypropylene, latex, reinforced PVC, PVC, coated or co-extruded plastic materials which have suitable strength and suitably low gas permeability. In another form, the inner container is constructed of one or more of the materials selected from the group comprising: density polyethylenes, polyurethanes and co extrusions thereof.

To provide redundancy in the event of a puncture, the cushion may comprise a plurality of fluid-tight inner containers arranged inside the housing. In one form, the cushion is provided with a surplus of inner containers over and above the number required to fill the volume occupied by a fully inflated housing. Each of the plurality of inner containers may be independently collapsible.

In one form, each of the plurality of inner containers is an elongated container arrayed side-by-side a single row whereby the overall shape of the cushion is substantially planar. In another form, the plurality of elongated inner containers is arranged randomly within the housing. To assist in effecting a random arrangement of inner containers, the plurality of inner containers may be capable of sliding movement relative to each other such that the overall shape of the cushion can take any shape.

In one form, the housing wraps snugly around each of the plurality of inner containers to reduce the likelihood of accidental puncture of the housing. In this embodiment, the housing may be formed from a first sheet and a second sheet being joined together to form a plurality of stiffening ribs arranged in rows, each row containing one of the inner containers. The ribs provide increased rigidity to the cushion to assist in deployment during step a).

An impervious fluid seal may be formed at each of the plurality of ribs to retain fluid in the event of a leak of one of the inner containers.

In one form, the cushion comprises a plurality of inner containers and each inner container is configured to independently receive fluid from a fluid delivery system. Alternatively, each of the inner containers may be in fluid communication such that fluid supplied to the cavity of one of the inner containers is receivable within the cavity of each of the plurality of inner containers whereby the plurality of inner containers is simultaneously inflatable and collapsible. In one form, the cushion is one of a plurality of cushions positioned within the stope during step a).

According to a second aspect of the present invention there is provided a cushion for use in the method of mining a valuable metal or material in an ore body according to one form of the first aspect of the present invention.

According to a third aspect of the present invention there is provided a method of mining a valuable metal or material in an ore body substantially as herein described with reference to and as illustrated in the accompanying drawings.

According to a fourth aspect of the present invention, there is provided a cushion substantially as herein described with reference to and as illustrated in the accompanying drawings.

BRIEF DESCRIPTION OF THE DRAWINGS

In order to facilitate a more detailed understanding of the nature of the invention several embodiments of the present invention will now be described in detail, by way of example only, with reference to the accompanying drawings (not shown to scale), in which.

DETAILED DESCRIPTION

Particular embodiments of the present invention are now described. The terminology used herein is for the purpose of describing particular embodiments only, and is not intended to limit the scope of the present invention. Unless defined otherwise, all technical and scientific terms used herein have the same meanings as commonly understood by one of ordinary skill in the art to which this invention belongs.

The term "strike" refers to the angle of inclination of the surface of an ore body relative to a horizontal plane. The term "dip" is the direction and angle of inclination of the ore body, measured from a horizontal plane, perpendicular to the strike. The term "stope" is used to refer to an excavation from which ore has been removed in a series of cuts or "panels". The term "panel" refers to a segment of ore of a pre-defined volume which is designated for removal in a given drilling and blasting operation. The term "rise" is used to refer to an elongated substantially vertical or inclined shaft extending between a lower level and an upper level in a mine. A rise is cut as the first step in creating the stope. The term "drive" is used to refer to an elongated substantially longitudinal passageway in a mine extending generally in the direction of the strike. The term "shaft" is used to refer to a substantially vertical excavation in a mine for the purpose of providing access to an ore body. The term "incline" or "inclined shaft" is used to refer to a sloping excavation or slanting shaft.

The term "substance" refers to a kind of matter or material that can be a solid, liquid or a gas. The term "fluid" refers to gases and liquids. The term "compressible" refers to something that is capable of being made to occupy a smaller volume by the application of pressure or a similar process. The term "incompressible" refers to something that is not capable of being made to occupy a smaller volume by the application of pressure or a similar process.

Figure 1:
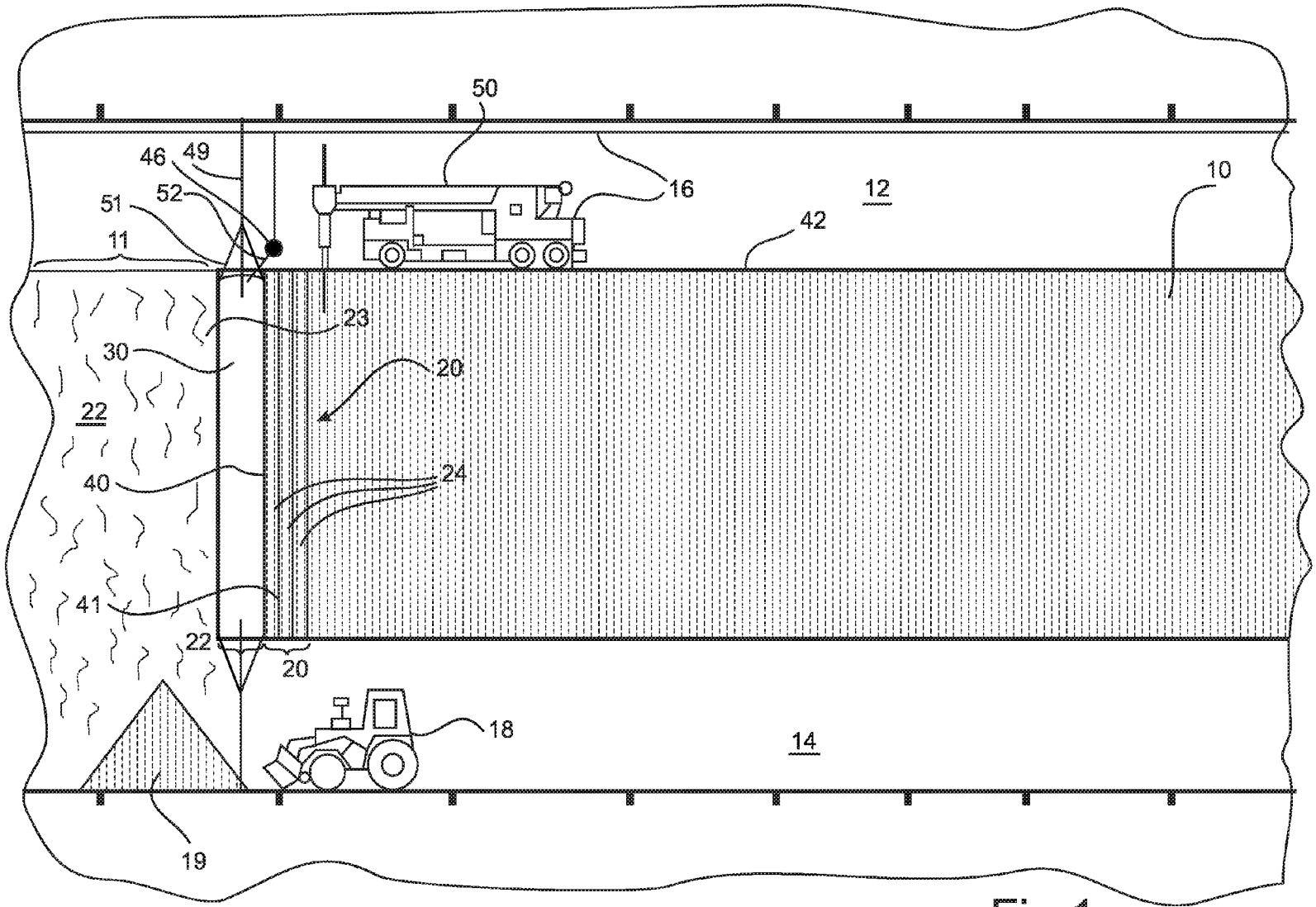
FIG. 1 is a side view of the mine showing the location of an ore body, an upper drive and a lower drive and the deployment of a collapsible cushion within the stope adjacent to the ore body facing wall.

With reference to the mine depicted in side view in FIG. 1, there is shown an ore body (10) containing a valuable metal or mineral, whether of igneous, metamorphic, or sedimentary origin. The ore body can be of any shape and is depicted as being substantially planar in cross-section for ease of description of the present invention. The mine is provided with upper and lower spaced-apart access drives ((12) and (14), respectively) located at different levels. With referent to FIG. 1, each of the upper drive (12) and the lower drive (14) pass through at least a portion of the ore body (10) and are arranged generally parallel to the strike of the ore body. As will be appreciated, other drives not shown in FIG. 1 can be located at the same or other levels within the mine to divide the ore body into a plurality of mineable segments.

The upper drive (12) provides access to excavation equipment (16) including but not limited to production drilling apparatus, blasting apparatus and services such as sand, water, compressed air and electricity. When each sequence of drilling and blasting operations has been completed, broken ore falls under the influence of gravity towards the lower drive (14). The lower drive provides access for a haulage system (18), such as a loader, to load and haul the mined broken ore (19) to a desired location. As will be appreciated, the haulage system can also be a scraper, a scraper conveyor, a scraper conveyor, a mini-scoop, tracked or rubber-tired haulage vehicles (such as a truck, a shuttle car, or a tractor trailer), water jets, rail cars, a haulage pipeline (such as a hydraulic hoist), and combinations thereof.

After development of the upper drive (12) and lower drive (14) has been completed, mining of the ore body (10) can commence. As a first step, a first panel (11) extending between the upper drive (12) and the lower drive (14) is excavated to commence creation of a "stope" (22). By way of example, the first panel (11) can be excavated by positioning drilling equipment (16) within the upper drive (12) and drilling a plurality of boreholes (24) in sequence into the ore body (10). Each borehole (24) extends downwardly from the upper drive (12) towards, and preferably breaking through into, the lower drive (14). After drilling of the plurality of boreholes has been completed, suitable explosives are charged within each borehole for detonation to create the void (22) by removing the first panel (11). Persons skilled in the art would be familiar with ways of designing specific drilling and blasting sequences and operations to produce chucks of broken ore of manageable size for hauling and further processing.

Drilling and blasting operations are repeated to progressively remove a second or subsequent panel (20) of the ore body to increase the size of the stope (22). In an analogous manner to the excavation of the first panel (11), drilling and blasting of the second or subsequent panel (20) is conducted using procedures that are known to persons skilled in the art, which procedures do not form part of the present invention. By way of example, the first rise can be mined in 5-20 m sections, blasting from the bottom up, and using voids provided by reamer holes (not shown) to prevent binding up of the first rise as the fragmented rock expands.

Using the methods and apparatus of the present invention, a cushion (30) is positioned within the stope (22) after the first panel (11) has been blasted and hauling operations associated with the broken rock generated in excavation of the first panel and stope generation have been completed, but before backfilling operations commence. The cushion (30) is positioned between the ore body facing wall (40) and a backfill segment of pre-defined volume which is designated for subsequent backfilling (23). In general terms, the cushion (30) is a fluid tight container that is used to create a collapsible void prior to backfilling operations, the void created by the cushion (30) being maintained during backfilling operations and then collapsed, depending on backfill material selection, either during or just prior to blasting operations.

With reference to FIG. 1, the cushion (30) is positioned after the first panel (11) has been excavated in such as way as to create a collapsible void or 'fake rise' of a controlled size at a pre-determined location. For ease of access to underground mining operations, the cushion may be inflatable. Inflation may occur either before or after the cushion (30) is positioned within the stope (22). For example, the inflatable cushion (30) can be in a rolled or folded configuration for transport underground. After transport underground, the cushion (30) is positioned against the ore body facing wall (40) using the deployment system (46). The cushion (30) is then secured and inflated in-situ prior to or during backfilling operations. Whilst the cushion (30) can be placed at any suitable location within the stope (22), best results are achieved by positioning the cushion (30) adjacent to the ore body facing wall (40).

Figure 2:
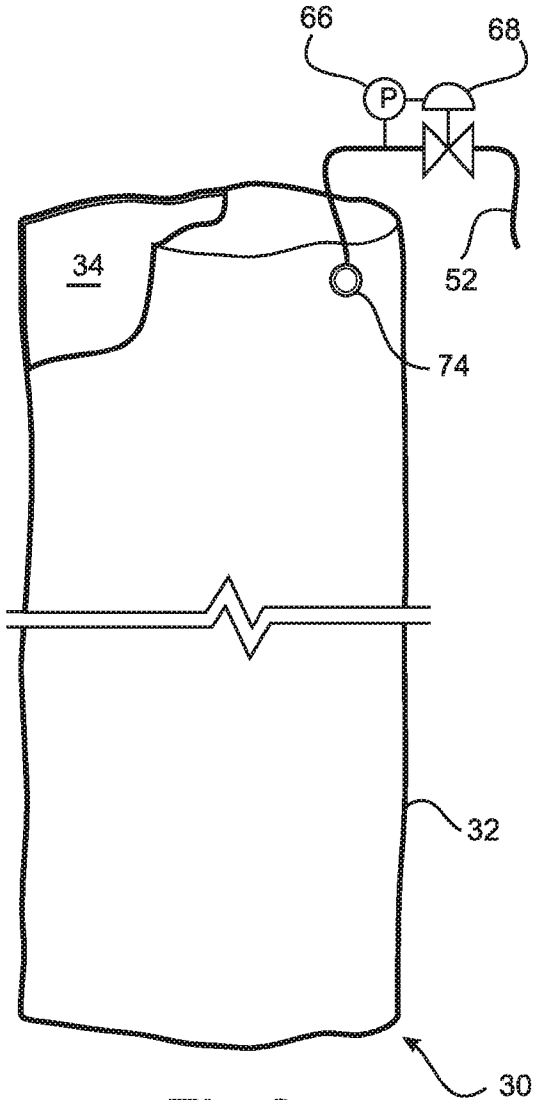
FIG. 2 is a partial cross-sectional view of a first embodiment of the present invention in which the cushion is partially inflated and comprises a single housing, the internal pressure of which is monitored using a pressure sensing means.

A first embodiment of a basic implementation of the cushion (30) is illustrated in FIG. 2. In this embodiment, the cushion (30) comprises an elongate fluid-tight housing (32) formed from a tear-resistant fluid impervious material having at least one cavity (34) therein which is isolated from the surrounding atmosphere and is capable of retaining a fluid under pressure. Between deployment and blasting, the internal pressure of the cushion (30) is monitored to ensure that the cushion does not collapse until blasting occurs. Whilst the inflated cushion (30) is in position against the ore body facing wall (40), a pressure sensing means (66) is used to monitor and maintain pressure. The pressure sensing means (66) may be used for providing feedback signals to a controller (68) regarding the internal pressure of the cushion (30). The feedback signal is compared with a fluid pressure set point whereby the controller (68) operates to regulate the flow of pressurized fluid through the umbilical line (52) to the cushion to ensure that the pressure within the cushion is maintained above the set point until the blasting operation commences. If desired, the controller (68) can be programmed to initiate inflation of the cushion as well as monitor the internal pressure after inflation until blasting operations are commenced. Preferably, the controller is a remote controller and the feedback signals are transmitted between the cushion to the controller using the umbilical line (52). Preferably the cushion (30) is able to maintain 0.5 to 50 psi (3.5 to 350 kPa) of internal pressure when it is being used to maintain a void before blasting of the second or subsequent panel (20).

Figure 3:
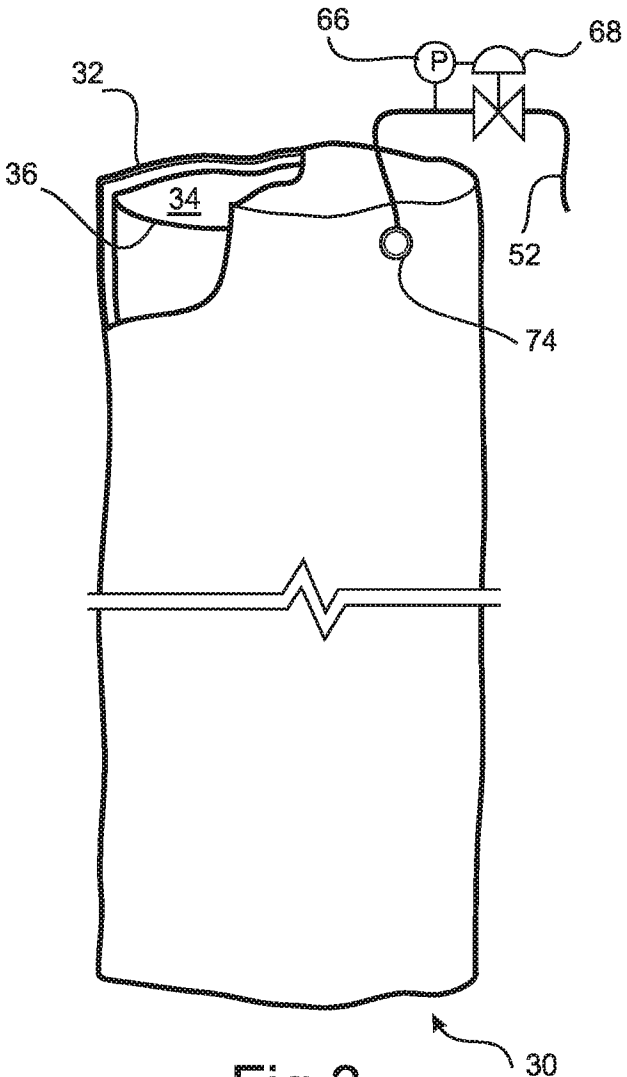
FIG. 3 is a partial cross-sectional view of a second embodiment of the present invention in which the cushion is partially inflated and is provided with a single inner container arranged to fit snugly inside the housing.

In a second embodiment illustrated in FIG. 3 for which like reference numerals refer to like parts, the cushion (30) is provided with an inner container (36) formed from a flexible fluid impervious material. In this embodiment, a more rigid housing (32) is used to shield the fluid tight inner container (36) from waste material used for backfilling operations which might otherwise affect the integrity of the fluid tight inner container (32), allowing a loss of pressure and a failure to maintain the void as required until blasting commences. The housing (32) may take a variety of forms, for example a bag, sleeve or other receptacle within which the fluid-tight inner container (36) is placed. The inner container (36) and the housing (32) are dimensioned so that, upon full inflation, the inner container (36) fits snugly inside the housing (32).

The inner container (36) of the cushion (30) may be constructed of any suitable material having low fluid permeability. By way of example, the inner container may be fabricated using plastic materials, rubber or other elastomeric materials, extrusion grade nylon, polyethylene, polyurethane, polypropylene, latex, polyvinylchloride ("PVC"), reinforced coated or co-extruded plastic materials, or a combination which have suitable strength and suitably low gas permeability. Polyethylenes, polyurethanes and co-extrusions are preferable to other types of materials. Preferably the inner container is constructed of an elastic material having low fluid permeability.

The housing (32) may be constructed of any suitable tear-resistant material to protect the inner container against damage when the cushion is positioned into a rise or during backfilling operations. One suitable tear-resistant material is woven polypropylene, polyester woven cloth, reinforced PVC, Kevlar or woven polyethylene. For best results, the tear-resistant material should also impart rigidity to the cushion whilst still allow for inflation thereof.

The inner container (36) and the housing (32) are sealed by means that are known in the art to be suitable for the materials of construction, for example using heat welding.

Figure 4:
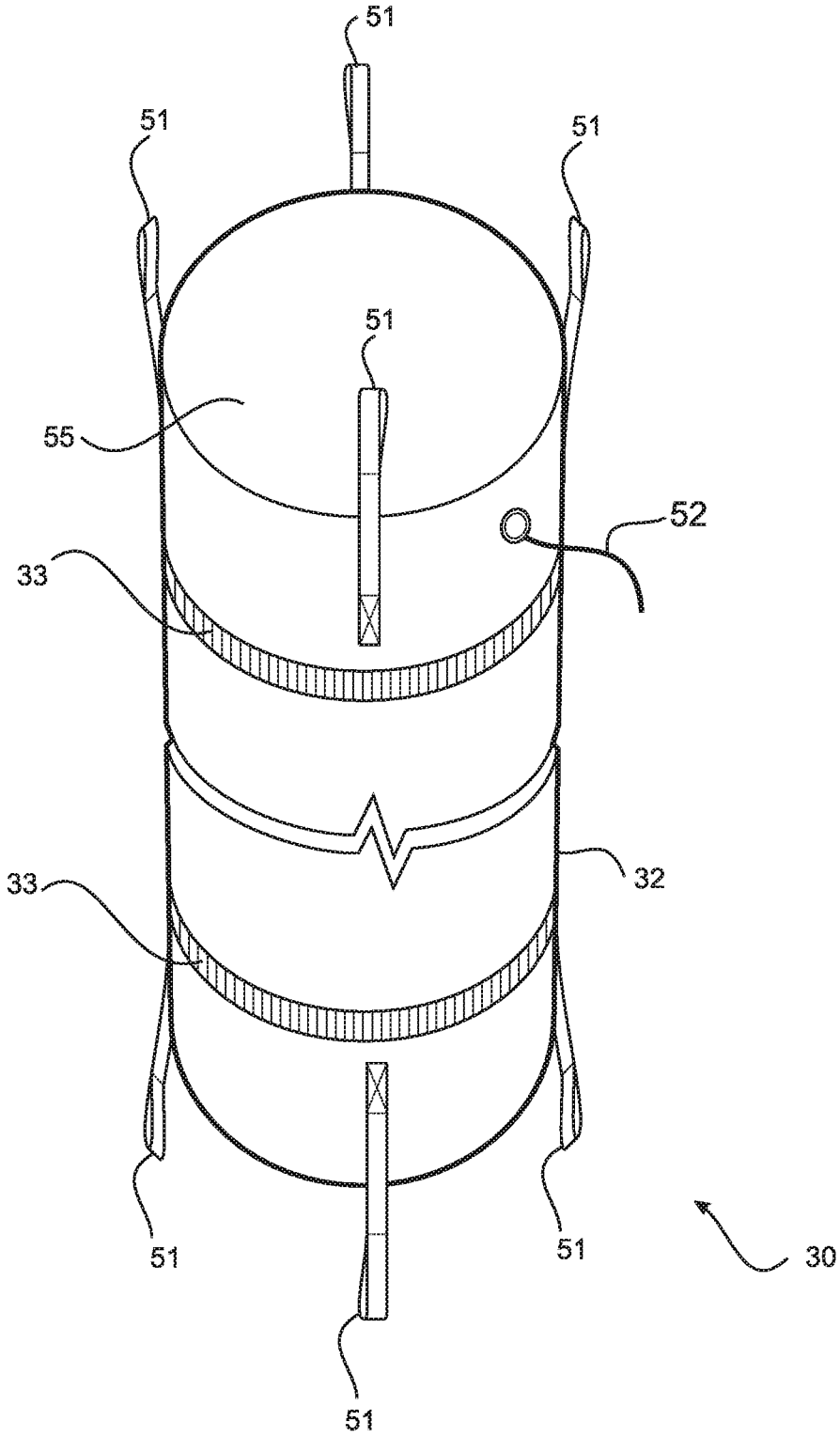
FIG. 4 is an isometric view of a third embodiment of the present invention illustrating the provision of handles for securing the position of the cushion in use.

With reference to a third embodiment illustrated in FIG. 4, the tear resistant housing (32) may further include one or more strengthening bands (33) arranged around the girth of the cushion (30) whereby the main axis of each of the strengthening bands is generally perpendicular to the vertical axis of the inflated cushion (30), advantageously reducing the risk of local bulging or bursting of the cushion (30) in use. If the cushion bulges in a local area during inflation, that area is more likely to be damaged during backfilling operations prior to blasting. Where more than one strengthening band (33) is used, the bands are positioned at spaced apart intervals to encourage even inflation of the cushion (30) in use.

The overall dimensions of the cushion can vary depending on such relevant factors as the size and type of ore body, the angle of the strike, the type of backfilling material being used, and the materials of construction of the cushion. In this regard, the overall dimensions of the cushion (30) may be in the range of 0.3-6 m in diameter when fully inflated or width when deflated or partially inflated and can range from 5-100 m in vertical height. Best results are achieved when the cushion (30) is dimensioned such that the length of the cushion is not less than 80%, not less than 85%, not less than 90% or not less than 95% of the distance between the floor (42) of the upper drive (12) and the ceiling (44) of the lower drive (14). For best results, the width of the cushion is from 5% to 75% of the width of the second or subsequent panel (20) being mined.

In use, the cushion (30) is positioned within the stope (22) using a deployment system (46). By way of example, the deployment system may include a support cable (49), a mobile hoist (50), and an umbilical line (52). Alternatively, the deployment system (46) can be located on a drilling rig, on an explosives rig (16). The umbilical line (52) is used to regulate or monitor the pressure within the cushion until blasting operations associated with the excavation of the second or subsequent panel (20) occur. When the cushion (30) is inflated, the umbilical line (52) is used to provide fluid to the cushion to allow the cushion to be inflated immediately prior to deployment or in-situ as described in greater detail below. Either way, the cushion (30) can advantageously be inflated using substances which are provided as services during underground mining, including fluids such as compressed air or water; or other substances such as sand.

The cushion (30) is maintained in an upright configuration using the support cable (49). The cushion (30) is provided with one or more anchors or handles (51) to assist in positioning the cushion (30) within the stope (22), with the support cable (49) being releasably attachable to one of the handle(s) (51) during deployment. In the embodiment illustrated in FIG. 4, the cushion (30) has a first proximal end (55) and a second distal end (57) and the first end (55) is provided with one or more of the anchors (51) to assist in deploying the cushion (30) using the support cable (49) as set out above. In this embodiment, the second end (57) of the cushion (30) is provided with one or more additional handles (51) to assist in anchoring the cushion (30) within the stope (22) in the direction of the lower drive (14) to obviate the risk of the cushion rising upwardly during backfilling operations.

Using the methods and apparatus of the present invention, backfilling of the stope (22) occurs after positioning and inflation of the cushion (30). In essence the handles (51) anchor the cushion (30) in place within the stope (22) during backfilling operations. When backfilling of the backfill segment (23) of the stope (22) has been completed, drilling equipment (16) is again positioned within the upper drive (12) for excavating the second or subsequent panel (20) in an analogous manner to the excavation of the first rise. When the second or subsequent panel (20) of the ore body (10) is excavated using blasting, the volumetric area occupied by the cushion (30) is caused or allowed to collapse to allow the fragmented ore to expand into and fill the void previously created and maintained by the cushion (30).

Figure 6:
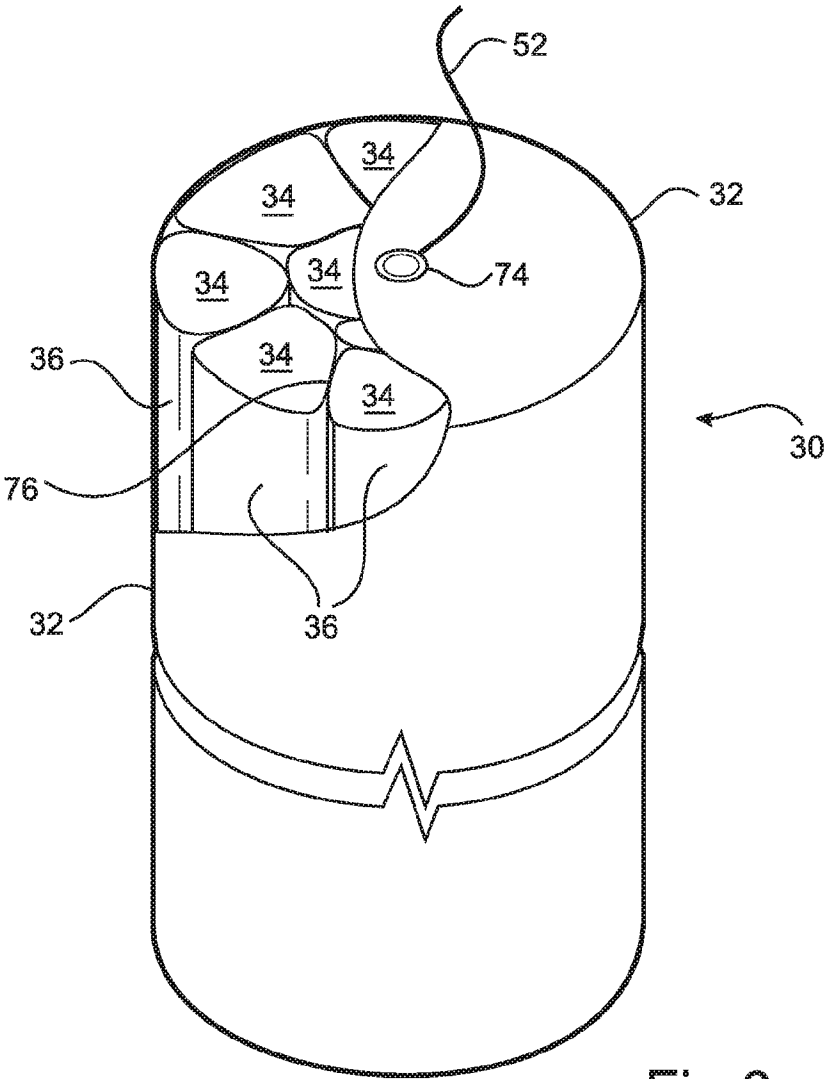
FIG. 6 illustrates the cushion of FIG. 5 in a deflated condition for ease of transport.
Figure 7:
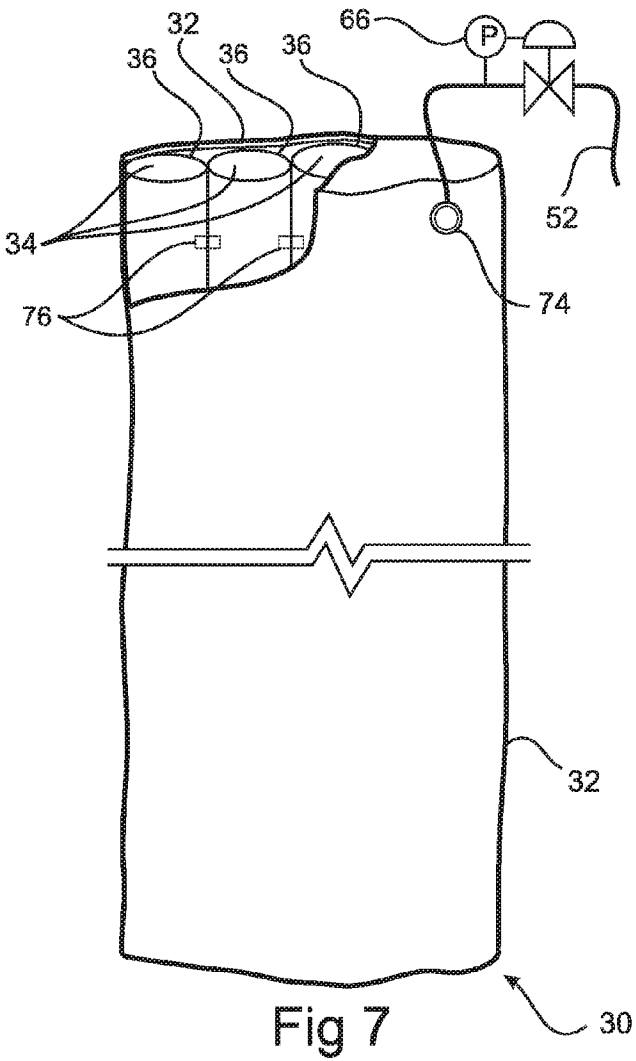
FIG. 7 is a partial cross-sectional view of a fifth embodiment showing the plurality of inner containers arranged randomly within the housing; and, FIG. 8 is a partial cross-sectional view of a sixth embodiment of the present invention in which the housing wraps snugly around each of a plurality of inner containers to provide the cushion with a plurality of stiffening ribs.

Fourth and fifth embodiments are illustrated in FIGS. 6 and 7, respectively, for which like reference numerals refer to like parts. In FIGS. 6 and 7, the cushion (30) is shown in its inflated condition for clarity. In both embodiments, the cushion (30) comprises a plurality of fluid-tight inner containers (36) arranged inside a single outer protective housing (32), each of the plurality of inner containers (36) being independently collapsible. In the embodiment illustrated in FIG. 7, each of the plurality of inner containers (36) is an elongated cylindrical container arrayed side-by-side a single row whereby the overall shape of the cushion upon inflation is substantially planar. This arrangement is used for ease of positioning of the cushion (30) against the ore body facing wall (40).

Figure 5:
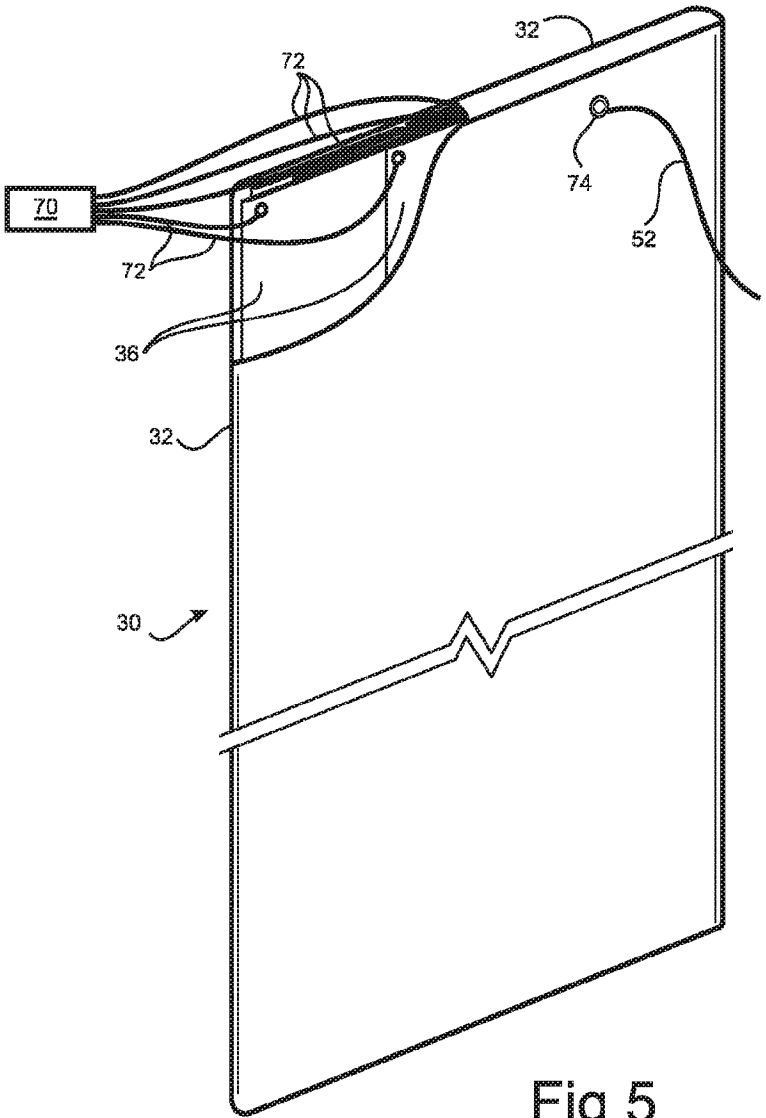
FIG. 5 is a partial cross-sectional view of a fourth embodiment of the cushion in which the cushion comprises a plurality of inner containers arranged inside a single housing connected to a pressure sensor, controller and umbilical line.

In the embodiment illustrated in FIG. 6, the plurality of elongated cylindrical inner containers (36) is arranged randomly within the housing (32) and the overall shape of the cushion upon inflation would be circular in cross-section if no external pressure was being applied to it. FIG. 5 shows a partial cross-sectional isometric view of the cushion of FIG. 6 prior to inflation. In this embodiment, the plurality of inner containers is capable of sliding movement relative to each other such that the overall shape of the cushion (30) can take any shape. Using this embodiment, the cushion (30) may be provided with a surplus of inner containers (36) over and above the number required to fill the volume occupied by a fully inflated housing (32). This is done so that if any of the inner containers are punctured prior to blasting operations, one or more of the surplus inner containers is inflated to fill the space previously occupied by a punctured container. This redundancy is built into the cushion (30) to maintain the overall integrity of the cushion until blasting occurs.

Figure 8:
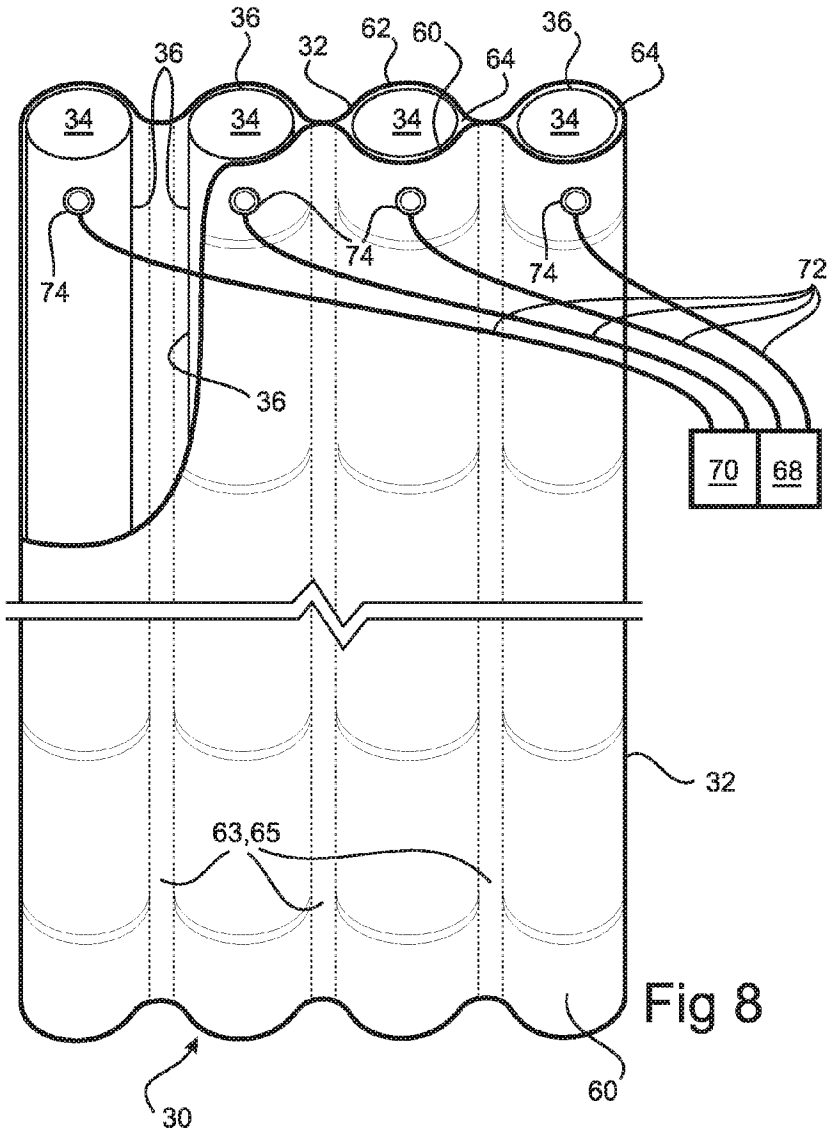

A sixth embodiment is illustrated in FIG. 8 for which like reference numerals refer to like parts. In this embodiment, the cushion (30) comprises a plurality of elongate cylindrical inner containers (36) arranged within an outer protective housing (32). In this sixth embodiment, the housing (32) wraps snugly around each individual inner container (36) to reduce the likelihood of accidental puncture of the housing (32). The housing (32) is formed from a first sheet (60) and a second sheet (62) being joined together, for example, using stitching or gluing, to form a plurality of seams (63) delineating a corresponding plurality of compartments (64) arranged in rows, each compartment containing one of the inner containers (36). In this way, each of the plurality of seams (64) has its main axis generally aligned with the main longitudinal axis of the inflated cushion (30). An impervious fluid seal is formed at each of the plurality of seams (63) to retain fluid within each of the compartments (64) in the event of a leak or a puncture of one of the inner containers (36). If desired, the seams (63) may be reinforced whereby the cushion (30) is provided with a plurality of stiffening ribs (65), advantageously increasing the overall rigidity of the cushion (30) in use.

In the embodiment illustrated in FIG. 8, the plurality of inner container (36) is configured to receive fluid from a fluid delivery system in the form of a manifold (70) and a corresponding plurality of fluid delivery tubes (72). In this embodiment, the controller (68) is used to independently regulate the distribution of the fluid from the manifold (70) to each of the inner containers (36) to control the flow of fluid along each of the fluid delivery tubes (72).

In its most basic form, the cushion (30) is collapsed due to puncture of the cushion by the fragmented ore during blasting. However, various mechanisms for inflating and collapsing the cushions are now described. It is to be clearly understood that these mechanisms can be used for any of the above-described embodiments.

In its most basic form, the cushion (30) is inflated by being partially or completely filled with an incompressible substance such as sand or an incompressible fluid such as water. The incompressible fluid is sealed within the cushion and then released immediately prior to or during blasting operations to allow the cushion to collapse. By way of example, the cushion may be deflated during blasting operations as a consequence of broken rock penetrating or puncturing the cushion, resulting in the release of the incompressible fluid from the inner container (36) of the cushion (30) resulting in collapse of the cushion.

In another form, backfilling operations may be conducted using a settable composition capable of retaining its shape when set so that the void is maintained until blasting operations occur. In this form, the void can be maintained after setting of the settable composition has been achieved, even if the cushion is accidently or deliberately deflated. In this form, the cushion may be inflated using a compressible fluid such as air or an incompressible substances such as sand or water. When the cushion is inflated using a compressible fluid and the fragmented ore that is generated during blasting expands to occupy a larger volume during excavation of the second or subsequent panel (20), the fragmented ore applies pressure to the cushion in excess of its internal pressure, causing compression of the fluid and controlled collapse of the cushion during blasting operations. The fluid within the cushion (30) is simply compressed to occupy a smaller volume as a result of pressure being applied to the cushion by the fragmented ore. When the cushion is inflated using an incompressible fluid, the cushion can be deflated by releasing the incompressible fluid from the cushion after backfilling operations have been completed and the settable composition has set, allowing the cushion (30) to be re-used if desired.

In another form of the invention, the cushion (30) is placed in a stope (22) and partially or completely filled with a compressible fluid such as air to create the void into which fragmented rock can expand during subsequent blasting operations for a second or subsequent panel (20). Sufficient gas is provided to the cushion, for example using the umbilical line (52), to maintain inflation of the cushion (30) until blasting operations occur. In this form, the pressure sensing means (66) is used to monitor and maintain pressure during backfilling operations. A feedback signal is compared with a fluid pressure set point whereby the controller (68) operates to regulate the flow of pressurized fluid through the umbilical line (52) to the cushion to ensure that the pressure within the cushion is maintained above the set point until the blasting operation commences.

To inflate the cushion for use using a compressible fluid such as air directed through an umbilical line (52), the cushion is provided with a normally closed one-way valve assembly (74) arranged to open upon application of fluid pressure on the inlet side of the valve. By way of example, the valve assembly may include a fitting adapted for connection to compressed air services provided in the upper drive or the lower drive. By way of example, fluid can be provided to the cushion using a stand-alone diesel compressor or air provided by mine services. The pressure within each inner container (36) is monitored to ensure that the cushion (30) remains inflated until the next drilling and blasting operations have been completed.

Alternatively, to facilitate inflation of the cushion using an incompressible fluid such as water, the cushion (30) may be provided with a two-way valve that operable in one way to allow fluid ingress into the inner container (36) to allow the inner container to expand and operable in another way to allow fluid to be expelled out of the inner container (36) to cause the controlled collapse of the cushion (30) during blasting. The same result can be achieved using an inlet valve assembly operable to allow fluid to pass into the inner container to allow inflation of the cushion and a separate outlet valve assembly operable to allow fluid to be expelled out of the inner container to cause the controlled collapse of the cushion during blasting.

When the cushion is provided with a plurality of inner containers (36) as illustrate in FIGS. 6, 7 and 8, each of the inner containers may be in fluid communication such that fluid supplied to the cavity (34) of one of the inner containers (36) is receivable within the cavity of each of the plurality of inner containers. In this way, the plurality of inner containers (36) is simultaneously inflatable and collapsible. In this example, the manifold (70) may be used to direct the flow of pressurized fluid into the plurality of inner containers (36) via an inlet valve (74) associated with one of the plurality of inner containers (36), with the fluid being distributed to the remaining inner containers (36) via a corresponding plurality of interconnecting channels (76). However, for maximum control, each of the plurality of inner containers (36) is independently inflatable and independently collapsible.

Now that several embodiments of the invention have been described in detail, it will be apparent to persons skilled in the relevant art that numerous variations and modifications can be made without departing from the basic inventive concepts. The foregoing is not intended to limit the invention to the form or forms disclosed herein. Although the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter. For example, whilst it is preferable for ease of deployment to use a single cushion, it is equally possible to deploy a plurality of cushions in side-by-side alignment along the ore body facing wall or randomly distributed within the stope to achieve the same effect. All such modifications and variations are considered to be within the scope of the present invention, the nature of which is to be determined from the foregoing description and the appended claims.

All of the patents cited in this specification, are herein incorporated by reference. It will be clearly understood that, although a number of prior art publications are referred to herein, this reference does not constitute an admission that any of these documents forms part of the common general knowledge in the art, in Australia or in any other country. In the summary of the invention, the description and claims which follow, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Claims defining the invention:

1. A method of mining a valuable metal or material in an ore body comprising the steps of:

(a) placing a cushion in a stope, wherein the cushion creates a void into which fragmented rock can expand during subsequent blasting operations for a second or subsequent panel, wherein the cushion comprises a housing surrounding a fluid-tight inner container; and (b) maintaining the void until blasting operations occur, wherein the void is caused to collapse to accommodate fragmented ore generated during blasting operations;

wherein the ore body is accessible via upper and lower spaced-apart access located at different levels and the cushion is dimensioned such that the length of the cushion is not less than 80%, not less than 85%, not less than 90% or not less than 95% of the distance between the floor of the upper drive and the ceiling of the lower drive.

2. The method of claim 1, wherein the cushion is inflatable.

3. The method of claim 1, wherein the cushion is inflated after step (a).

4. The method of claim 1, wherein step (a) comprises placing the cushion adjacent to an ore body facing wall.

5. The method of claim 1, further comprising the step of securing and then backfilling the stope to secure the position of the cushion within the stope during step (b).

6. The method of claim 1, wherein the cushion is partially or completely filled with an incompressible substance and the void is caused to collapse by release of the incompressible substance prior to blasting operations.

7. The method of claim 1, wherein the cushion is partially or completely filled with a compressible fluid and the fluid within the cushion is compressed to occupy a smaller volume as a result of pressure being applied to the cushion by the fragmented ore during blasting operations.

8. The method of claim 1, wherein the cushion is capable of withstanding forces of 3.5 to 350 kPa of internal pressure during step (b).

9. The method of claim 1, wherein the housing is constructed of a tear-resistant material.

10. The method of claim 1, wherein the housing is constructed from a woven polypropylene or a woven polyethylene.

11. The method of claim 1, wherein a width of the cushion is 5% to 75% of a width of the second or subsequent panel as measured across a wall of the ore body facing the stope.

12. The method of claim 1, wherein an umbilical line is used to regulate or monitor the pressure within the cushion during step (b).

13. The method of claim 1, wherein a pressure sensing means is used for providing feedback signals to a controller regarding the internal pressure of the cushion during step (b), and wherein the feedback signal is compared with a fluid pressure set point whereby the controller operates to regulate the flow of pressurized fluid through an umbilical line to the cushion to ensure that the pressure within the cushion is maintained above the set point until the blasting operation commences.

14. The method of claim 1, wherein the inner container is formed from a fluid impervious material capable of retaining a fluid under pressure.

15. The method of claim 1, wherein the housing is a bag, sleeve or other receptacle within which a fluid-tight inner container is placed.

16. The method of claim 1, wherein the inner container and the housing are dimensioned so that, upon inflation, the inner container fits snugly inside the housing.

17. The method of claim 1, wherein the inner container is constructed of a material having low fluid permeability.

18. The method of claim 1, wherein the inner container is constructed of one or more materials comprising at least one of plastic materials, rubber or other elastomerics, extrusion grade nylon, polyethylene, polyurethane, polypropylene, latex, reinforced PVC, PVC, and coated or co-extruded plastic materials which have suitable strength and suitably low gas permeability.

19. The method of claim 1, wherein the inner container is constructed of one or more of the materials comprising at least one of density polyethylenes, polyurethanes and co-extrusions thereof.

20. The method of claim 1, wherein the cushion is one of a plurality of cushions positioned within the stope during step (a).

21. A method of mining a valuable metal or material in an ore body comprising the steps of:

(a) placing a cushion in a stope, wherein the cushion creates a void into which fragmented rock can expand during subsequent blasting operations for a second or subsequent panel, wherein the cushion comprises a housing surrounding a fluid-tight inner container; and (b) maintaining the void until blasting operations occur, wherein the void is caused to collapse to accommodate fragmented ore generated during blasting operations;

wherein the cushion is partially or completely filled with an incompressible substance and the step of securing and then backfilling the stope to secure the position of the cushion comprises backfilling using a settable composition.

22. A method of mining a valuable metal or material in an ore body comprising the steps of:

(a) placing a cushion in a stope, wherein the cushion creates a void into which fragmented rock can expand during subsequent blasting operations for a second or subsequent panel, wherein the cushion comprises a housing surrounding a fluid-tight inner container; and (b) maintaining the void until blasting operations occur, wherein the void is caused to collapse to accommodate fragmented ore generated during blasting operations;

wherein the cushion comprises a plurality of fluid-tight inner containers arranged inside the housing.

23. The method of claim 22, wherein the cushion is provided with a surplus of inner containers over and above the number required to fill the volume occupied by a fully inflated housing.

24. The method of claim 22, wherein each of the plurality of inner containers is independently collapsible.

25. The method of claim 22, wherein each of the plurality of inner containers comprises an elongated container arrayed side-by-side a single row such that the overall shape of the cushion is substantially planar.

26. The method of claim 22, wherein the plurality of elongated inner containers is arranged randomly within the housing.

27. The method of claim 26, wherein the plurality of inner containers is configured to facilitate sliding movement relative to each other such that the overall shape of the cushion can take any shape.

28. The method of claim 22, wherein the housing wraps snugly around each of the plurality of inner containers to reduce the likelihood of accidental puncture of the housing.

29. The method of claim 28, wherein the housing is formed from a first sheet and a second sheet being joined together to form a plurality of stiffening ribs arranged in rows, each row containing one of the inner containers.

30. The method of claim 29, wherein an impervious fluid seal is formed at each of the plurality of ribs to retain fluid in the event of a leak of one of the inner containers.

31. The method of claim 22, wherein the cushion comprises a plurality of inner containers and each inner container is configured to independently receive fluid from a fluid delivery system.

32. The method of claim 22, wherein each of the inner containers is in fluid communication such that fluid supplied to the cavity of one of the inner containers is receivable within the cavity of each of the plurality of inner containers and the plurality of inner containers is simultaneously inflatable and collapsible.

* * * * *